US009624701B2

(12) United States Patent
Taylor et al.

(10) Patent No.: US 9,624,701 B2
(45) Date of Patent: Apr. 18, 2017

(54) MULTI-POINT LOCK HAVING A SHOOTBOLT WITH A FLAT DRIVERAIL MOUNTED IN A NARROW GROOVE

(75) Inventors: Matt Taylor, Milton, WI (US); Scott Trogner, Fort Atkinson, WI (US); Dan Mattrisch, Fort Atkinson, WI (US)

(73) Assignee: HOPPE Holding AG, Müstair (CH)

( * ) Notice: Subject to any disclaimer, the term of this patent is extended or adjusted under 35 U.S.C. 154(b) by 0 days.

(21) Appl. No.: 13/219,142

(22) Filed: Aug. 26, 2011

(65) Prior Publication Data

US 2012/0049540 A1 Mar. 1, 2012

Related U.S. Application Data

(60) Provisional application No. 61/378,288, filed on Aug. 30, 2010.

(51) Int. Cl.

| | |
|---|---|
| ***E05C 1/06*** | (2006.01) |
| ***E05C 1/12*** | (2006.01) |
| ***E05C 9/04*** | (2006.01) |
| ***E05C 9/22*** | (2006.01) |
| *E05C 1/00* | (2006.01) |
| *E05C 1/02* | (2006.01) |
| *E05C 1/04* | (2006.01) |
| *E05C 1/10* | (2006.01) |
| *E05C 9/00* | (2006.01) |
| *E05C 9/10* | (2006.01) |
| *E05B 63/08* | (2006.01) |

(52) U.S. Cl.

CPC ..... *E05C 9/04* (2013.01); *E05C 9/22* (2013.01); *E05B 63/08* (2013.01); *Y10T 29/49826* (2015.01); *Y10T 292/0962* (2015.04)

(58) Field of Classification Search

CPC ..... E05C 9/04; E05C 9/22; Y10T 29/49826; Y10T 292/0962; E05B 63/08

USPC ..... 292/2, 3, 5, 6, 7, 32, 33, 35, 36, 40, 41, 292/42, 63, 64, 66, 137, 165, 166, 168, 292/174, 143, 145, 146, 147, 150, 292/DIG. 15, DIG. 44, DIG. 51, DIG. 53, 292/DIG. 55, DIG. 64, 332, 335

See application file for complete search history.

(56) References Cited

U.S. PATENT DOCUMENTS 652,279 A * 6/1900 Lauer ..... E05C 9/043 292/36
920,501 A * 5/1909 Thorp ..... E05B 65/0003 292/33
928,904 A * 7/1909 Cottrell ..... E05B 65/5238 292/36

(Continued)

*Primary Examiner* — Kristina Fulton
*Assistant Examiner* — Faria Ahmad
(74) *Attorney, Agent, or Firm* — Reinhart Boerner Van Deuren P.C.

(57) ABSTRACT

A multi-point lock having an easy to install modular drive mechanism for shootbolts located at the top and bottom edges of a door in which the multi-point locking system is installed that requires only relatively simple door preparation. The shootbolt operating mechanism is installed into a narrow groove cut into a lateral edge of a door which may be cut using relatively simple tools in relatively quick fashion. The shootbolt actuating mechanisms are flat driverails that are made of flat barstock that fit slidably entirely within the narrow groove defined in the lateral edge of the door above and below the mortise pocket.

28 Claims, 5 Drawing Sheets

(56) References Cited

U.S. PATENT DOCUMENTS 1,094,143 A * 4/1914 Hagstrom ..... E05B 65/0075 70/118
1,495,820 A * 5/1924 Tierney ..... 70/108
1,621,740 A * 3/1927 Pavola ..... E06B 7/18 292/254
1,668,354 A * 5/1928 Canon ..... E05F 11/48 292/194
1,850,222 A * 3/1932 Carlson ..... E05C 9/02 292/167
2,069,883 A * 2/1937 Hennicke ..... E05B 17/0025 292/39
2,122,959 A * 7/1938 Scharff ..... B61D 45/006 292/36
2,123,188 A * 7/1938 Hurlbut ..... E05C 17/443 292/139
2,157,016 A * 5/1939 Reynaud ..... E05F 11/14 292/146
2,597,459 A * 5/1952 Dickinson ..... E05D 13/1253 16/197
2,886,960 A * 5/1959 Willett ..... E05B 65/10 160/353
3,005,671 A * 10/1961 Majeski ..... A01K 97/06 206/315.11
3,080,622 A * 3/1963 Mendelsohn ..... E06B 3/2605 292/145
3,158,016 A * 11/1964 Fay ..... E05C 9/025 292/143
3,352,257 A * 11/1967 Lehnert ..... B61D 45/006 292/36
3,433,180 A * 3/1969 Shook ..... B61D 45/006 292/139
3,455,591 A * 7/1969 Powers ..... 292/335
3,578,369 A * 5/1971 Coopersmith ..... E05C 7/06 292/182
3,582,122 A * 6/1971 Foster ..... E05B 63/20 292/21
3,606,775 A * 9/1971 Atkins ..... E05C 1/04 292/145
3,617,080 A * 11/1971 Miller ..... E05C 9/045 292/171
3,649,060 A * 3/1972 Ruff ..... E05C 1/04 292/147
3,910,612 A * 10/1975 Guiraud ..... E05B 15/024 292/33
3,993,335 A * 11/1976 Schmidt ..... 292/21
4,005,886 A * 2/1977 Lirette ..... E05C 7/06 292/177
4,063,763 A * 12/1977 van Herpen ..... E05C 9/008 292/160
4,159,838 A * 7/1979 Wilzig ..... E05B 17/2038 292/150
4,227,723 A * 10/1980 Rosell ..... E05C 9/002 292/161
4,265,051 A * 5/1981 Williams ..... E05F 5/12 49/367
4,288,944 A * 9/1981 Donovan ..... E05C 9/042 292/39
4,303,264 A * 12/1981 Uehara ..... E05C 9/02 292/7
4,315,647 A * 2/1982 Wilzig ..... E05C 1/065 292/143
4,362,328 A * 12/1982 Tacheny ..... E05C 9/043 292/36
4,639,021 A * 1/1987 Hope ..... E05C 9/043 292/40
4,643,005 A * 2/1987 Logas ..... E05C 9/026 292/20
4,671,015 A * 6/1987 Curry ..... E05D 7/1005 16/229
4,690,445 A * 9/1987 Hartley ..... E05B 15/0205 292/147
4,728,131 A * 3/1988 Burns ..... E05C 9/048 292/153
4,813,251 A * 3/1989 Fowler ..... E05B 65/0003 292/181
4,896,905 A * 1/1990 Lehr ..... E05C 9/02 292/23
4,902,056 A * 2/1990 Prevot ..... E05B 63/185 292/335
4,950,005 A * 8/1990 Cudd ..... E05B 63/185 292/150
4,973,091 A * 11/1990 Paulson ..... E05C 9/041 292/216
5,058,938 A * 10/1991 Doring ..... E05C 9/021 292/335
5,083,398 A * 1/1992 Kolbeck ..... E05B 63/248 292/165
5,118,145 A * 6/1992 Tucker ..... E05C 9/02 292/158
5,120,094 A * 6/1992 Eaton ..... E05B 65/087 292/159
5,133,581 A * 7/1992 Coleman ..... E05C 19/166 292/251.5
5,139,291 A * 8/1992 Schultz ..... E05C 1/10 292/337
5,171,047 A * 12/1992 Korb ..... E05C 9/021 292/39
5,184,852 A * 2/1993 O'Brien ..... E05B 65/1006 292/153
5,197,771 A * 3/1993 Kaup ..... E05C 7/04 292/45
5,290,077 A * 3/1994 Fleming ..... E05B 65/087 292/341.11
5,328,217 A * 7/1994 Sanders ..... E05B 15/0245 292/341.19
5,346,266 A * 9/1994 Bisbing ..... E05B 17/0025 292/142
5,350,207 A * 9/1994 Sanders ..... E05B 15/0245 292/335
5,370,428 A * 12/1994 Dreifert ..... E05C 9/185 292/161
5,373,716 A * 12/1994 MacNeil ..... E05C 9/026 292/165
5,375,894 A * 12/1994 Schlack ..... E05B 5/003 292/182
5,492,208 A * 2/1996 Goossens ..... E06B 5/164 292/2
5,542,720 A * 8/1996 Fleming ..... E05B 63/20 292/32
5,603,534 A * 2/1997 Fuller ..... E05B 55/005 292/2
5,660,420 A * 8/1997 Smith ..... E05C 9/20 24/580.11
5,782,114 A * 7/1998 Zeus ..... E05C 9/002 292/150
5,813,710 A * 9/1998 Anderson ..... E05B 5/00 292/150
5,878,606 A * 3/1999 Chaput ..... E05B 63/185 292/35
5,901,989 A * 5/1999 Becken ..... E05C 7/06 292/35
5,906,403 A * 5/1999 Bestler ..... E05B 65/087 292/117
6,007,113 A * 12/1999 Prevot ..... E05B 63/06 292/116
6,068,304 A * 5/2000 Lindqvist ..... E05B 9/00 292/1
6,076,384 A * 6/2000 Thielmann ..... E05B 47/026 292/144
6,112,471 A * 9/2000 Welch ..... E05B 15/0205 292/DIG. 53
6,135,511 A * 10/2000 Smith ..... E05C 9/063 292/139
6,209,364 B1 * 4/2001 Collet ..... E05C 9/042 292/39

(56) References Cited

U.S. PATENT DOCUMENTS 6,209,931 B1 * 4/2001 Von Stoutenborough ..... E05C 9/041 292/160
6,217,087 B1 * 4/2001 Fuller ..... E05B 55/00 292/33
6,282,929 B1 * 9/2001 Eller ..... E05C 9/02 292/32
6,382,685 B1 * 5/2002 Hammond ..... E05B 63/0069 292/145
6,457,751 B1 * 10/2002 Hartman ..... E05B 17/2053 292/137
6,641,182 B2 * 11/2003 Schlack ..... E05B 17/0025 292/336.3
6,666,486 B1 * 12/2003 Fleming ..... E05B 17/2069 292/145
6,688,656 B1 * 2/2004 Becken ..... E05B 65/0858 292/26
6,729,662 B2 * 5/2004 Wang ..... G06F 1/181 292/42
6,817,637 B1 * 11/2004 Anderson ..... E05B 15/022 292/150
6,883,837 B1 * 4/2005 Lin ..... E05C 7/06 292/33
6,905,152 B1 * 6/2005 Hudson ..... E05C 1/065 292/143
6,962,377 B2 * 11/2005 Tonges ..... E05B 63/185 292/332
6,971,686 B2 * 12/2005 Becken ..... E05B 63/20 292/142
7,003,991 B2 * 2/2006 Alizade ..... E05B 65/0075 109/59 R
7,013,688 B2 * 3/2006 Chen ..... E05C 9/042 292/34
7,036,854 B1 * 5/2006 Lai ..... E05C 1/065 292/141
7,201,408 B2 * 4/2007 Cennamo, Jr. ..... E05B 15/02 292/137
7,353,637 B2 * 4/2008 Harger ..... E05B 15/0086 292/302
7,404,306 B2 * 7/2008 Walls ..... E05C 9/20 292/139
7,494,163 B2 * 2/2009 Monts de Oca ..... E05C 1/06 292/139
7,497,487 B2 * 3/2009 Burmahln ..... E05B 9/082 292/200
7,513,539 B2 * 4/2009 Phipps ..... E05B 17/2053 292/143
7,513,540 B2 * 4/2009 Hagemeyer ..... E05B 15/0205 292/156
7,513,542 B2 * 4/2009 Schumm ..... E05C 17/446 292/163
7,526,933 B2 * 5/2009 Meekma ..... E05B 63/0056 292/39
7,543,860 B2 * 6/2009 Meeks ..... E05C 1/04 292/137
7,631,526 B2 * 12/2009 Squier ..... E05B 9/08 292/DIG. 53
7,707,862 B2 * 5/2010 Walls ..... E05C 9/20 292/156
7,708,322 B2 * 5/2010 Timothy ..... E05C 9/063 292/137
7,735,882 B2 * 6/2010 Abdollahzadeh ..... E05C 7/04 292/44
7,752,809 B2 * 7/2010 Di Vinadio ..... E05D 15/5208 292/32
7,752,875 B2 * 7/2010 Constantinou ..... E05C 9/1841 292/41
7,856,857 B2 * 12/2010 Tsai ..... E05C 9/004 292/34
7,946,080 B2 * 5/2011 Ellerton ..... E05C 7/04 292/32
8,061,166 B2 * 11/2011 Tsai ..... E05C 9/10 292/35
8,099,907 B2 * 1/2012 Balbo Di Vinadio ..... E05D 15/5208 292/32
8,157,298 B2 * 4/2012 Mitchell ..... E05C 7/04 292/197
8,157,299 B2 * 4/2012 Mitchell ..... E05C 7/04 292/197
8,161,685 B2 * 4/2012 Salgado ..... E06B 7/2303 160/40
8,182,002 B2 * 5/2012 Fleming ..... E05B 15/004 292/158
8,353,541 B2 * 1/2013 Minter ..... E05C 9/10 292/137
8,398,126 B2 * 3/2013 Nakanishi ..... E05B 63/185 292/1.5
8,839,562 B2 * 9/2014 Madrid ..... E05C 1/12 292/140
2002/0104339 A1 * 8/2002 Saner ..... E05C 9/1841 70/108
2007/0029812 A1 * 2/2007 Monts de Oca ..... E05C 1/06 292/137
2008/0087052 A1 * 4/2008 Abdollahzadeh ..... E05C 7/04 70/93
2008/0150300 A1 * 6/2008 Harger ..... E05B 15/0086 292/32
2009/0019779 A1 * 1/2009 Nakanishi ..... E05B 63/185 49/449
2011/0018285 A1 * 1/2011 Mitchell ..... E05C 7/04 292/161
2011/0204657 A1 * 8/2011 Lambertini ..... E05C 9/02 292/33
2012/0001443 A1 * 1/2012 Mitchell ..... E05B 63/242 292/341.16
2012/0049540 A1 * 3/2012 Taylor ..... E05C 9/04 292/157
2012/0049541 A1 * 3/2012 Taylor ..... E05C 9/185 292/157
2012/0162873 A1 * 6/2012 Luo ..... H01H 3/122 361/679.01
2012/0248789 A1 * 10/2012 Mattrisch ..... E05C 9/20 292/33
2013/0026768 A1 * 1/2013 Nolte ..... E05B 63/00 292/42

* cited by examiner

FIG. 1
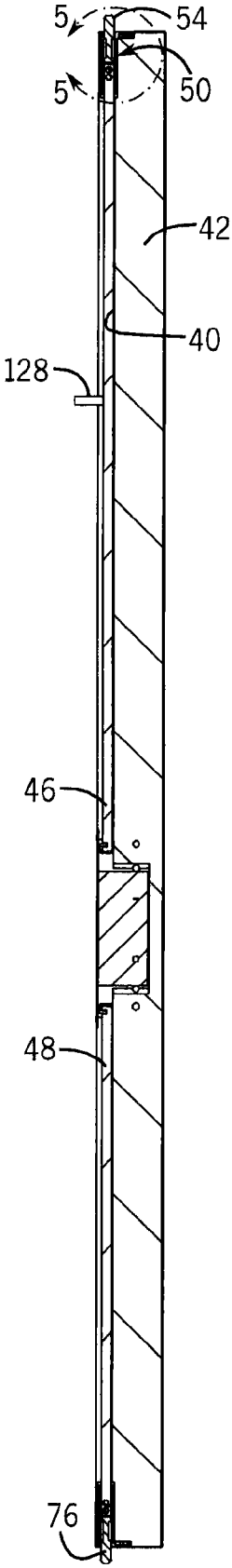
FIG. 2
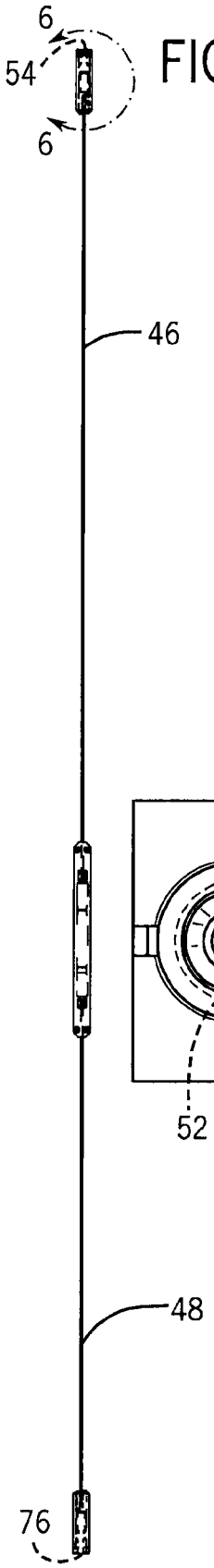
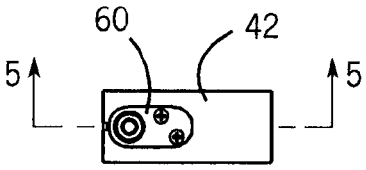
FIG. 3
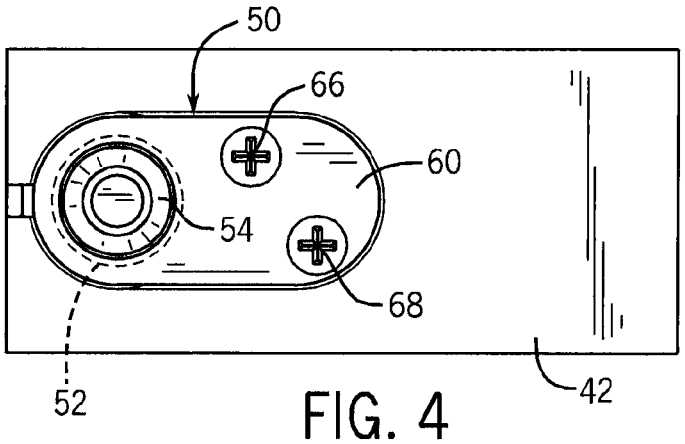
FIG. 4

MULTI-POINT LOCK HAVING A SHOOTBOLT WITH A FLAT DRIVERAIL MOUNTED IN A NARROW GROOVE

IDENTIFICATION OF RELATED APPLICATIONS

This patent application is a non-provisional application and claims priority to U.S. Provisional Patent Application No. 61/378,288, filed on Aug. 30, 2010, which is hereby incorporated herein by reference in its entirety.

BACKGROUND OF THE INVENTION

Field of the Invention

The present invention relates generally to multi-point locking systems, and more particularly to a multi-point lock having an easy to install modular drive mechanism for shootbolts located at one of the top, bottom and lateral edges of a door in which the multi-point locking system is installed that requires only relatively simple door preparation.

Simple locks have a mortise unit mounted adjacent the edge of a door with a latch and, optionally, a deadbolt that extend from the mortise unit into a latch plate mounted in the door frame into which the door is installed. An increased level of security is afforded by multi-point door locks to provide more secure closure and locking. Typical conventional multi-point door locks have more than one latch or bolt that engages the door frame or adjacent panel, for example a French door. Multiple bolts are substantially more difficult to overcome in a forcible entry than a single deadbolt and latch and facilitates enhanced weather sealing.

For example, instead of the conventional single latch and deadbolt extending from the mortise unit, three bolts and a latch may be used. A first deadbolt and latch engage with the door frame (or with a second door) that is locked into the closed position. A second bolt and a third bolt are respectively mounted at the top and bottom edges of the door above and below the mortise unit respectively to engage the upper and lower portions of the door frame, respectively. The second and third bolts, referred to as bolts, for example, shootbolts, tonguebolts, roundbolts, rollerbolts, swingbolt, and hookbolt are also controlled by the mortise unit, and operate simultaneously with the deadbolt extending from the mortise unit. Examples of such multi-point locks may be found, for example, in U.S. Pat. No. 5,782,114, to Zeus et al., and in U.S. Pat. No. 6,209,931, to Von Stoutenborough at al., both of which are hereby incorporated herein.

Existing multipoint locks require extensive and complex preparation of the door to install the shootbolts of a conventional multi-point lock, including, for example, the installation of a square hole from the top to the bottom of the door to allow the installation of the shootbolts at the top and bottom edges of the door. Further, one installed, such conventional multi-point locks typically require the removal of the door in order to remove the lock from the door. It will be appreciated that such conventional multi-point locks are complex and expensive to install into a door, and that fairly complex and precise equipment is required in order to install such conventional multi-point locks into a door.

It is accordingly the primary objective of the present disclosure that it provide an easy installation of a multi-point lock into a door, not requiring a complex installation process. It is a related objective that the multi-point lock of the present disclosure be installable in a door using only relative simple tools to prepare the door for installation of the bolt and its bolt actuating mechanism. It is another objective of the multi-point lock of the present disclosure that the bolt and its bolt actuating mechanism be of relatively simple mechanical construction to further facilitate their installation into a door.

It is yet another objective of the present disclosure that the multi-point lock and/or mortise unit be removable from a door without requiring the door to be removed. It is a related objective of the present disclosure that the multi-point lock of the present disclosure be of modular construction to facilitate both the installation as well as the removal of the multi-point lock of the present disclosure. It is a further objective the multi-point lock of the present disclosure that it be adaptable to fit doors of any size, preferably in a single kit which accommodates doors of different sizes.

The multi-point lock of the present disclosure must also be of construction which is both durable and long lasting, and it should also require little or no maintenance to be provided by the user throughout its operating lifetime. In order to enhance the market appeal of the multi-point lock of the present disclosure, it should also be of inexpensive construction to thereby afford it the broadest possible market. Finally, it is also an objective that all of the aforesaid advantages and objectives be achieved by the multi-point lock of the present disclosure without incurring any substantial relative disadvantage.

SUMMARY OF THE INVENTION

The disadvantages and limitations of the background art discussed above are overcome by the present invention. With this invention, the mortise lock, two bolt assemblies, and two bolt actuating mechanisms are provided which are of modular construction. The shootbolt operating mechanism is installed into a thin or narrow groove cut into a lateral edge of a door which may be cut using relatively simple tool, for example, a router, in relatively quick fashion. A pocket for a mortise unit is cut into the lateral edge of the door as is conventional. Housings for the bolt assemblies are installed into cylindrical apertures drilled into the top end bottom edges of the door adjacent to and in communication with the narrow groove cut in the lateral edge of the door.

The bolt actuating mechanisms are flat driverails that are made of flat barstock that fit slidably entirely within the narrow groove cut into the lateral edge of the door above and below the mortise pocket. There is no channel member or separate guide member positioned in the narrow groove. A distal end of each of the driverails is attached to a bolt by pushing the distal end of the driverail through a bolt housing, attaching the driverail to the bolt, and retracting the bolt into the bolt housing with the driverail. A proximal end of each of the driverails has an engagement mechanism located thereupon for engagement by the mortise unit.

The mortise unit has mating engagement mechanisms locate on the top and bottom sides thereof. As the mortise unit is slid into the mortise pocket in the door, the mating engagement mechanism on the top of the mortise unit will drivingly engage the proximal end of the driverail operating the bolt located in the top edge of the door, and the mating engagement mechanism on the bottom of the mortise unit will drivingly engage the proximal end of the driverail operating the bolt located in the bottom edge of the door. It will thus be appreciated that the mortise unit may simultaneously open and close a deadbolt extending laterally from the mortise unit as well as the bolts located at the top and bottom of the door.

A thin cap or filler piece may be mounted on the lateral edge of the door to visually conceal the narrow groove and the driverails. The housings for the bolt assemblies may have different mounting plates having different numbers of apertures for receiving mounting screws that are screwed onto the top or the bottom of the door. The bolts may be of either cylindrical or square configuration, as desired.

It may therefore be seen that the present invention teaches a multi-point lock having a bolt actuating mechanism that is easy to install in a door, and which does not require a complex installation process. The multi-point lock of the present disclosure has a bolt and a bolt actuating mechanism that are installable in a door using only relative simple tools to prepare the door for installation of the bolt and its bolt actuating mechanism. The bolt and its bolt actuating mechanism are of relatively simple mechanical construction to further facilitate their installation into a door.

The multi-point lock and/or mortise unit of the present disclosure is removable from a door without requiring the door to be removed. It is of modular construction to facilitate both the installation as well as the removal of the multi-point lock of the present disclosure. The multi-point lock of the present disclosure is be adaptable to fit doors of any size, with a single kit accommodating doors of different sizes.

The multi-point lock of the present disclosure is of a construction which is both durable and long lasting, and which will require little or no maintenance to be provided by the user throughout its operating lifetime. The multi-point lock of the present disclosure is also of inexpensive construction to enhance its market appeal and to thereby afford it the broadest possible market. Finally, all of the aforesaid advantages and objectives are achieved by the multi-point lock of the present disclosure without incurring any substantial relative disadvantage.

DESCRIPTION OF THE DRAWINGS

These and other advantages of the present invention are best understood with reference to the drawings, in which:

FIG. 1 is a somewhat schematic cross-sectional view of a portion of the closing edge of a door showing a kerf into which the shootbolt actuating driverails of the present invention are installed to drive shootbolts respectively located at the top and bottom of the door;

FIG. 2 is a side view of the shootbolt actuating driverails illustrated in FIG. 1 and the shootbolt assemblies to which they are respectively connected;

FIG. 3 is a top plan view of the top edge of the door illustrated on FIG. 1 showing one of the shootbolt assemblies which is mounted therein;

FIG. 4 is an enlarged top plan view of the shootbolt assembly illustrated in FIG. 3;

DETAILED DESCRIPTION OF THE EXEMPLARY EMBODIMENT

Figure 5:
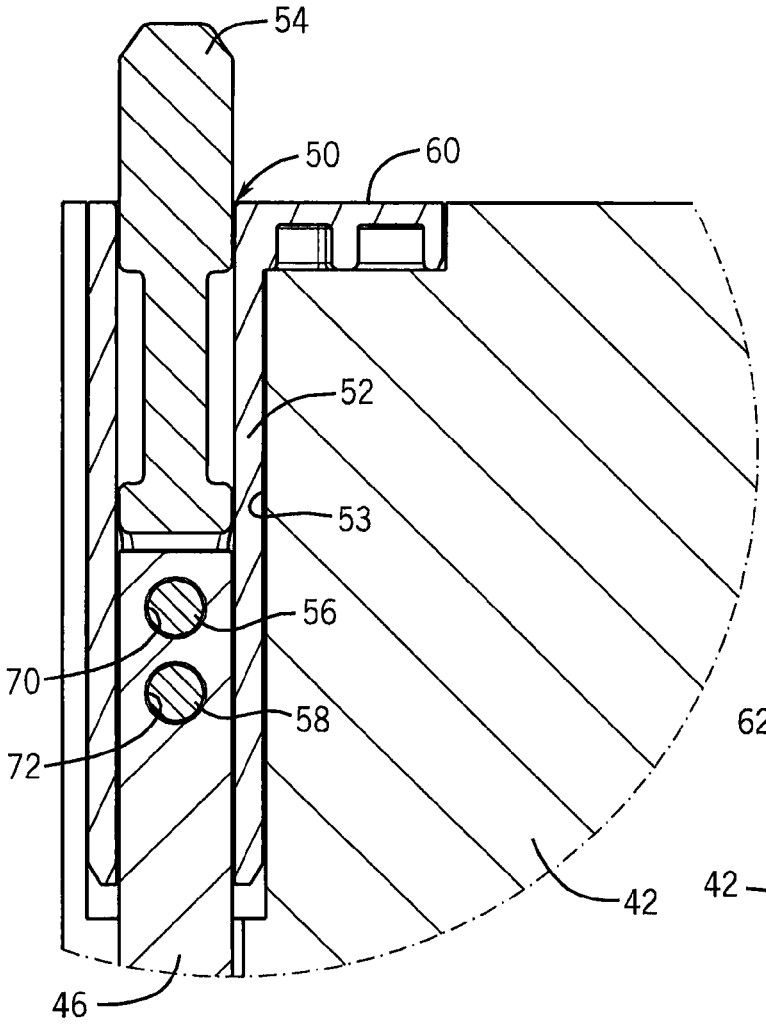
FIG. 5 is a cross-sectional view of the shootbolt assembly illustrated in FIGS. 3 and 4.
Figure 6:
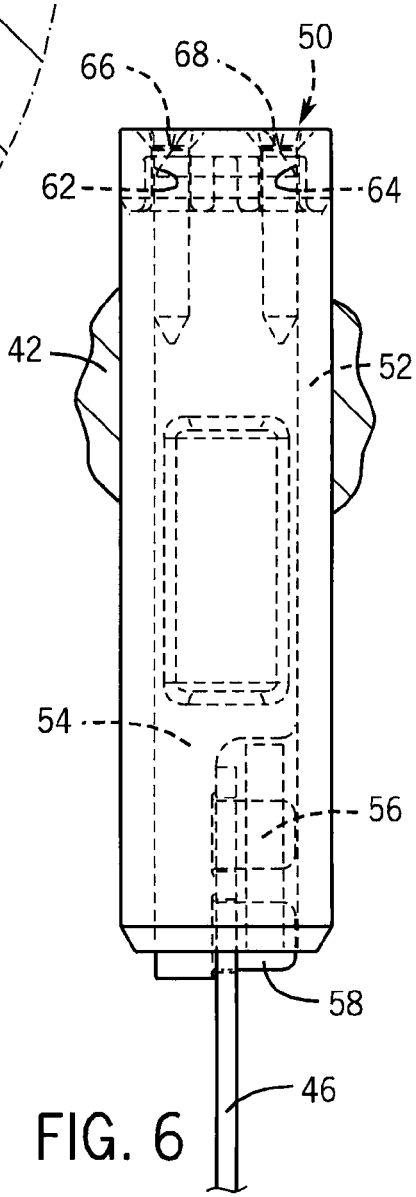
FIG. 6 is a lateral side view of the shootbolt assembly illustrated in FIGS. 3 through 5, with phantom lines showing the connection of the shootbolt actuating driverail to the shootbolt.
Figure 8:
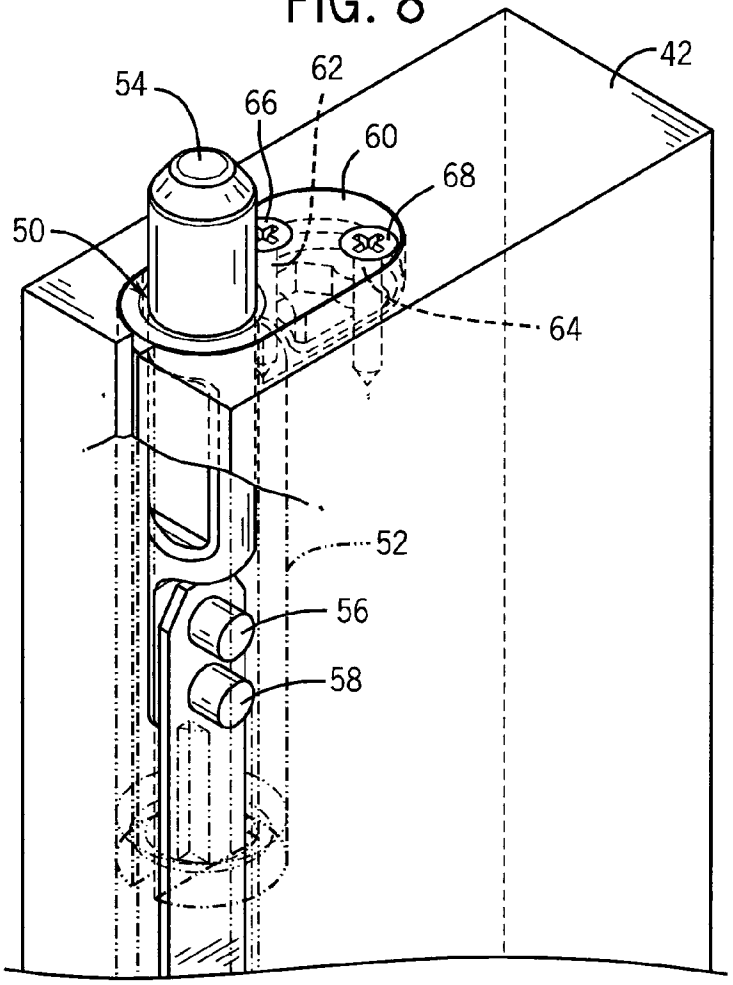
FIG. 8 is an isometric view of the shootbolt assembly illustrated in FIGS. 3 through 7, with the door shown in phantom lines and a portion of the housing of the shootbolt assembly being shown in phantom lines for clarity.
Figure 7:
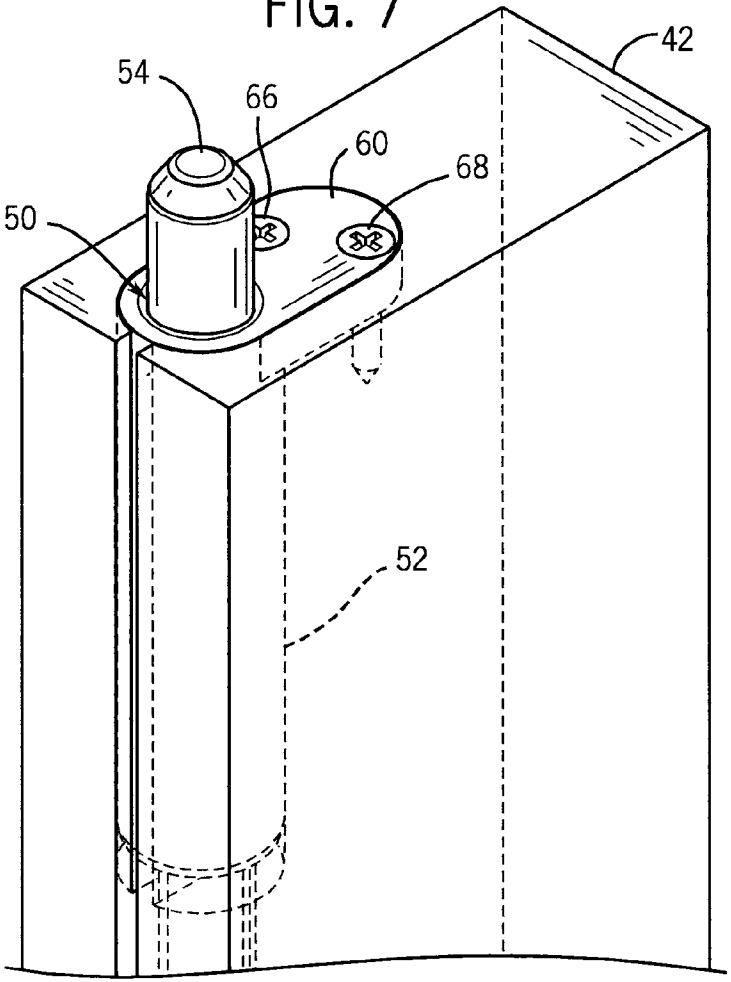
FIG. 7 is an isometric view of the shootbolt assembly illustrated in FIGS. 3 through 6, with the door shown in phantom lines.

The descriptions herein are directed to multi-point locks using bolts referred to as shootbolts extending from one of the top edge and bottom edge of a door, and more typically from both the top and bottom edges of the door. It should be understood that the term "bolt" as used herein in a multi-point lock is not an elongated fastener having a threaded portion and a head. As used herein, a "bolt" is a component of a multi-point lock that extends from a locking device installed in a top, bottom, and lateral edge of a door or window to engaged and secure the door or window to its frame or to another adjacent member, i.e. a French door unit.

It should also be understood that a bolt used in a multi-point lock may also be a shootbolt, tongue bolt, roundbolt, rollerbolt, swingbolt, and a hookbolt. Also, a multi-point lock can be configured to include bolts extending from a lateral edge of a door in addition to the top and bottom edge of the door, for example a 3 or 4 bolt multi-point lock.

The preferred embodiment of the multi-point lock of the present invention is shown in FIGS. 1 through 9, and includes five primary components: a mortise unit for installation into the lateral edge of a door, two shootbolt assemblies for installation into the top and bottom edges of the door adjacent to the lateral edge thereof, and two shootbolt actuating mechanisms for installation into a thin groove cut into the lateral edge of the door. There is no channel member or separate guide member positioned in the narrow groove. The primary focus of the invention, however, is on the shootbolt actuating mechanisms and their installation into the dado cut into the lateral edge of the door.

A thin groove 40 is cut into the lateral edge of the door 42. A flat driverail 46 is located and retained in the narrow groove 40 in the lateral edge of the door 42 in the upper portion thereof. Similarly, a flat driverail 48 is located in the narrow groove 40 in the lateral edge of the door 42 in the lower portion thereof.

For purposes of this application the term "narrow groove" shall mean a groove defined in a lateral edge of a door or window, with the groove having a width or diameter within the range of 4% to 20% of the width of the lateral edge of the door or window. A preferred configuration of a narrow groove is within the range of 7% to 15% of the width of the lateral edge of the door or window. For example, a door having a lateral edge dimension (door thickness) of 1.75 inches (44.45 mm) could have a narrow groove configured with a diameter (width) of 5 mm that being 11% of the lateral edge dimension (door thickness).

A shootbolt assembly 50 is installed into the top edge of the door 42 adjacent to the lateral edge thereof. The shootbolt assembly 50 has a shootbolt housing 52 which may be cylindrical and is installed into a cylindrical aperture 53 drilled into the top edge of the door 42 adjacent to the and in communication with the narrow groove 40. A shootbolt 54 is slidably located in the shootbolt housing 52 and has one side cut away on its lower end with two pins 56 and 58 extending laterally therefrom. If desired, the pin 58 may have a larger diameter than the pin 56.

The shootbolt assembly 50 has a mounting plate 60 located at the top thereof with a pair of apertures 62 and 64 located therein. The shootbolt housing 52 is installed into the cylindrical aperture 53 in the top edge of the door 42, and the shootbolt assembly 50 is retained in place with a pair of screws 66 and 68 which extend through the apertures 62 and 64 in the mounting plate 60, respectively, into the top edge of the door 42.

The driverail 46 has two mating apertures 70 and 72 located therein at its distal end thereof, which respectively engage the pins 56 and 58 in the shootbolt 54. The distal end of the driverail 46 may be extended in the narrow groove 40 through the interior of the shootbolt housing 52, facilitating the shootbolt 54 being mounted onto the driverail 46 by inserting the pins 56 and 58 on the shootbolt 54 into the mating apertures 70 and 72 in the driverail 46. The driverail 46 may then retracted, pulling the shootbolt 54 into the interior of the shootbolt housing 54. In another embodiment the driverail 46 and shootbolt 54 are a single integral member, with a driverail portion and a shootbolt portion. A shootbolt assembly 74 which is configured similarly to the shootbolt assembly 50 and which has a shootbolt 76 extendable therefrom is located in the bottom edge of the door 42, and the driverail 48 is configured similarly to the driverail 46 to facilitate mounting the distal end of the driverail 48 to the shootbolt 76.

Figure 9:
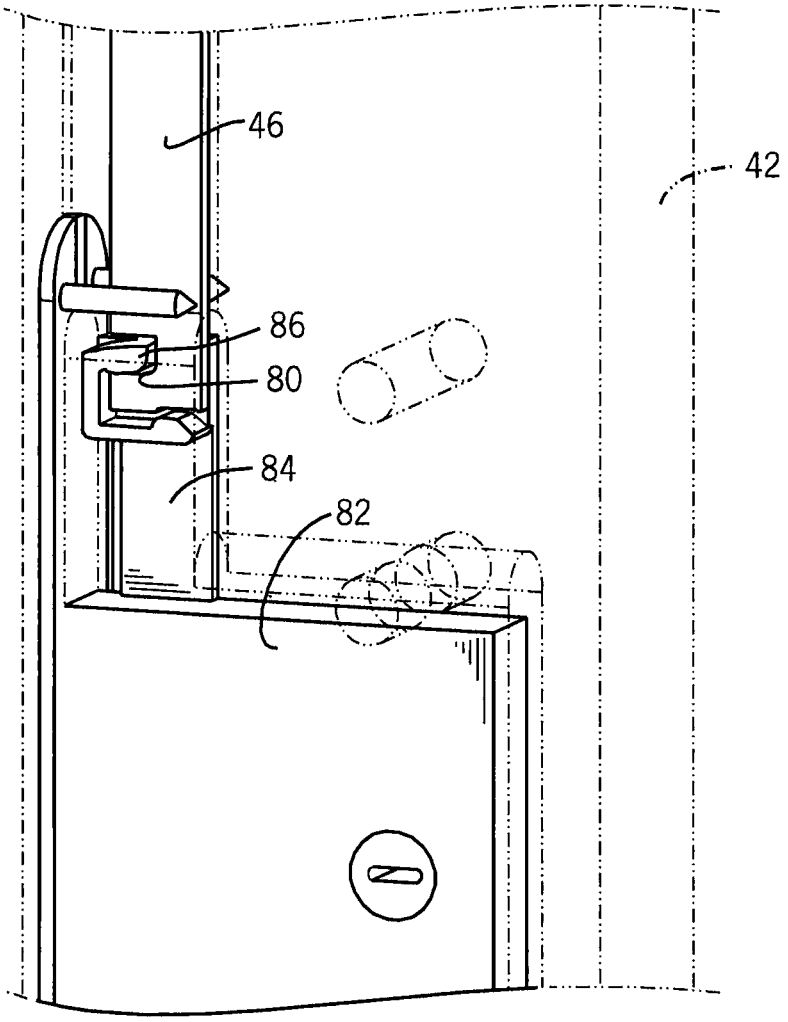
FIG. 9 is an isometric view of a portion of the door having the mortise unit mounted therein, showing the mechanism used by the mortise unit to drive the shootbolt actuating driverails, with the door shown in phantom lines.

The driverail 46 has a notch 80 located near its proximal end thereof, which notch 80 faces the outwardly from the narrow groove 40 when the driverail installed therein, as best shown in FIG. 9. A mortise unit 82 will be installed into the door 42 below the proximal end of the driverail 46. Extending from the top side of the mortise unit 82 is a reciprocally operable drive arm 84 which has a mating member 86 located at the upper end thereof. When the mortise unit 82 is installed into the door 42 with the driverail 46 previously installed, the mating member 86 of the mortise unit 82 will engage the notch 80 in the driverail 46. Thus, the mortise unit 82 will operate the driverail 46 to reciprocate the shootbolt 54.

Although it is not shown in the drawings, the driverail 48 is configured similarly to the driverail 46 with a notch at its proximal end. The mortise unit 82 has a reciprocally operable drive arm extending from its bottom side which has a mating member that engages the notch of the driverail 48 to operate it simultaneously with the driverail 46. Thus, the shootbolt 76 is operated simultaneously with the shootbolt 54.

In an embodiment configured as a 3 or 4 bolt multi-point lock, a bolt 128 is pivotably coupled to the driverail 46. The bolt 128 is located in the lateral edge of the door or window between the mortise unit 82 and the shootbolt 54. When the shootbolt 54 is in the retracted position, the bolt 128 is also in a retracted position within the narrow channel 40. When the shootbolt 54 is moved to an extended position by the mortise unit 82, the bolt 128 is also moved to an extended position to engage a lateral portion of a door frame.

In a typical configuration, as the driverail 46 moves toward the shootbolt 54, the bolt 128 swings out of the narrow channel 40 about a pivot coupling to the driverail 46. Likewise as the driverail 46 moves away from the shootbolt 54 (but still coupled to the shootbolt 54), the bolt 128 swings back to the narrow channel 40 about the pivot coupling into the retracted position. It should be understood that a second bolt 128, in some configurations, is pivotably coupled to the driverail 48 similarly to the driverail 46 and is located between the mortise unit 82 and the shootbolt 76. In such embodiment, the two shootbolts 54, 76 and the two bolts 128 operate simultaneously with the mortise unit 82.

Figure 10:
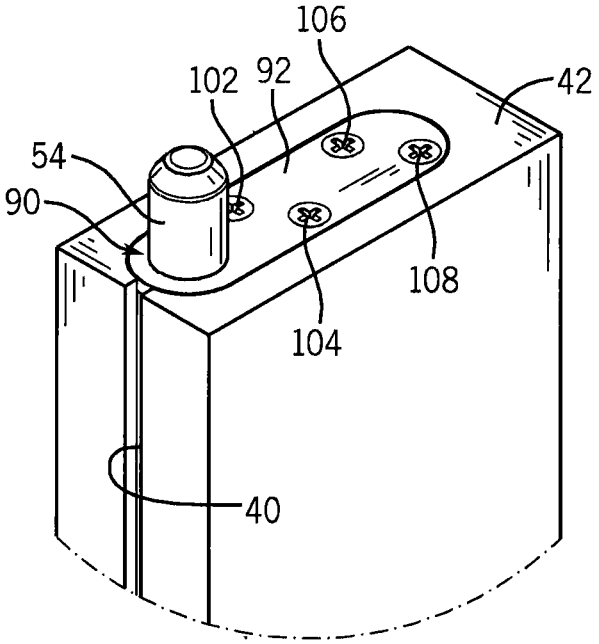
FIG. 10 is an isometric view of an alternate embodiment shootbolt assembly having a larger mounting plate.
Figure 11:
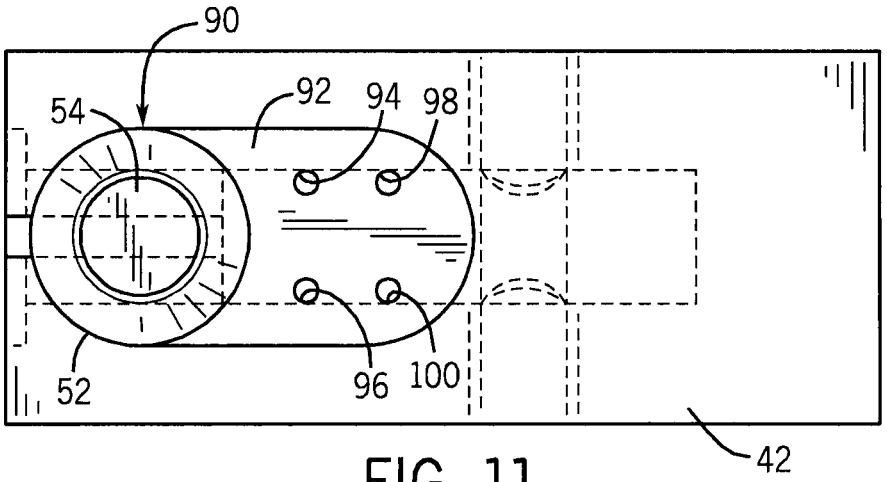
FIG. 11 is a top plan schematic view showing the alignment between the shootbolt assembly, the shootbolt actuating driverail, and the mortise unit.

Referring finally to FIGS. 10 and 11, a shootbolt assembly 90 has a mounting plate 92 located at the top thereof with four apertures 94, 96, 98, and 100 located therein. The shootbolt assembly 90 has a shootbolt housing (not shown) that is installed into a cylindrical aperture in the top edge of the door 42, and the shootbolt assembly 90 is retained in place with four screws 102, 104, 106, and 108 which respectively extend through the apertures 94, 96, 98, and 100 in the mounting plate 92 into the top edge of the door 42.

It should be understood that the multi-point lock disclosed herein provide configurations used with a door composed of wood, hollow-frame structure, metal or composite engineered material. The groove 40 or 120 can be formed, for example, by molding, as the non-wooden door is fabricated.

Thus, it will be appreciated that the multi-point lock of the present invention may be used for manipulating the position of a side hinged door or window including French door/window applications. In general, the multi-point lock of the present invention finds application with two types of locks. The first is an "Active" mortise lock case featuring a latch, dead bolt, and primary and secondary inputs for operating the device, an upper and lower drive rail, an upper and lower shootbolt, an upper and lower shootbolt guide, and strike plates. The second is an "Inactive" mortise lock case featuring at least one input for operating the device, an upper and lower drive rail; an upper and lower shootbolt, an upper and lower shootbolt guide, and strike plates. User interfaces with a patio door handle may be set to operate the locks. The locks provide capability to engage shootbolts into the head and the sill and also to engage an Active panel with an Inactive panel.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

The multi-point lock of the present disclosure allows for thin or narrow groove preparation for installing the lock, it accommodates a cap or filler for visually concealing the hardware, it allows for cost-effective transmission of mechanical force by minimizing materials needed to drive shootbolts, for example, there is no separate channel member disposed in the narrow groove, it reduces the number of fasteners needed for installation, and it allows for substantial reinforcement of the door or window to the frame for better weather sealing.

It may therefore be appreciated from the above detailed description of the preferred embodiment of the present disclosure that it teaches a multi-point lock having a shootbolt actuating mechanism that is easy to install in a door, and which does not require a complex installation process. The multi-point lock of the present disclosure has a shootbolt and a shootbolt actuating mechanism that are installable in a door using only relative simple tools to prepare the door for installation of the shootbolt and its shootbolt actuating mechanism. The shootbolt and its shootbolt actuating mechanism are of relatively simple mechanical construction to further facilitate their installation into a door.

The multi-point lock and/or mortise unit of the present disclosure is removable from a door without requiring the door to be removed. It is of modular construction to facilitate both the installation as well as the removal of the multi-point lock of the present disclosure. The multi-point lock of the present disclosure is adaptable to fit doors of any size, with a single kit accommodating doors of different sizes.

The multi-point lock of the present disclosure is of a construction which is both durable and long lasting, and which will require little or no maintenance to be provided by the user throughout its operating lifetime. The multi-point lock of the present disclosure is also of inexpensive construction to enhance its market appeal and to thereby afford it the broadest possible market. Finally, all of the aforesaid advantages and objectives are achieved by the multi-point lock of the present invention without incurring any substantial relative disadvantage.

Although the foregoing description of the present disclosure has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present disclosure. The particular embodiments and applications were chosen and described to provide the best illustration of the principles of the multi-point lock and its practical application to thereby enable one of ordinary skill in the art to utilize the invention in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A multi-point lock comprising:

at least one shootbolt assembly comprising a shootbolt slidably located in a shootbolt housing for mounting in one of a top and bottom edge of a door, wherein the shootbolt housing is installed into an aperture positioned on one of the top edge and the bottom edge of the door;

at least one driverail having proximal and distal opposite ends, said driverail configured for installation into a narrow groove defined in a lateral edge of the door;

the aperture is adjacent to and in communication with the narrow groove, wherein the width or diameter of the aperture is larger than the width or diameter of the narrow groove;

the driverail being installed in said narrow groove in a vertically slidable manner, the narrow groove configured to guide and retain the driverail in the door throughout the driverail motion, said distal end of said driverail being engageable with said shootbolt to drive said shootbolt between a retracted position in the shootbolt housing and an extended position from one of the top edge and the bottom edge of the door;

a notch defined in said driverail adjacent said proximal end thereof, the notch opening in a direction extending out of the narrow groove when the driverail is installed in the narrow groove; and a mortise unit adapted for installation into the lateral edge of the door through the narrow groove, said mortise unit having a driving element associated therewith that is moveable between unlocked and locked positions, said driving element extending into the notch defined in said driverail when said mortise unit is installed into the lateral edge of the door through the narrow groove after said driverail has been installed into said narrow groove to place the driving element in operative engagement with the driverail;

wherein said shootbolt is driven from said retracted position to said extended position when said driving element of said mortise unit is moved from said unlocked position to said locked position.

2. The multi-point lock of claim 1, wherein the mortise is one of an active mortise and an inactive mortise.

3. The multi-point lock of claim 1, further comprising:

an additional shootbolt assembly comprising an additional shootbolt slidably located in an additional shootbolt housing, said additional shootbolt for mounting in one of a top and bottom edge of the door, wherein the additional shootbolt housing is installed into an additional aperture positioned on one of the top edge and bottom edge of the door;

at least one additional driverail having proximal and distal opposite ends, said additional driverail being configured for installation into said narrow groove in a vertically slidable manner;

the additional aperture is adjacent to and in communication with the narrow groove, wherein the width or diameter of the additional aperture is larger than the width or diameter of the narrow groove;

the distal end of said additional driverail being engageable with said additional shootbolt to drive said additional shootbolt between a retracted position in the additional shootbolt housing and an extended position from one of the top edge and bottom edge of the door; and an additional notch defined in said additional driverail adjacent said proximal end thereof;

wherein the mortise includes an additional driving element associated therewith that is moveable between unlocked and locked positions, said additional driving element configured to be located in said additional notch defined in said additional driverail wherein both shootbolts are driven from said retracted position to said extended position when both driving elements of said mortise unit are moved from said unlocked position to said locked position.

4. The multi-point lock of claim 1, further comprising a cap configured to cover at least the width of the narrow groove.

5. The multi-point lock of claim 4, wherein the cap is configured to engage the narrow groove.

6. The multi-point lock of claim 1, wherein the narrow groove is configured as a groove having a width or diameter within a range of 4% to 20% of the width of the lateral edge of the door.

7. The multi-point lock of claim 6, wherein the narrow groove has a width or diameter within a range of 7% to 15% of the width of the lateral edge of the door.

8. A multi-point lock configured for a door having a top edge, a bottom edge, a first lateral edge in which a narrow groove is defined, and a second lateral edge opposite the first lateral edge, the multi-point lock comprising:

a first shootbolt assembly comprising a shootbolt slidably located in a shootbolt housing, said first shootbolt configured to be mounted in the top edge of the door, wherein the shootbolt housing is installed into an aperture positioned on the top edge of the door;

a first driverail having proximal and distal opposite ends, said first driverail configured to be installed into the narrow groove defined in the first lateral edge of the door;

the aperture is adjacent to and in communication with the narrow groove, wherein the width or diameter of the aperture is larger than the width or diameter of the narrow groove;

the first driverail configured to be installed in said narrow groove in a vertically slidable manner the narrow groove configured to guide and retain the driverail in the door throughout the driverail motion, said distal end of said first driverail being engageable with said first shootbolt to drive said first shootbolt between a retracted position in the shootbolt housing and an extended position from the top edge of the door;

wherein said first driverail includes a first engagement element adjacent said proximal end thereof, the first engagement element being a notch defined in said first driverail adjacent said proximal end thereof, the notch opening in a direction extending out of the narrow groove when the driverail is installed in the narrow groove;

a second shootbolt assembly comprising a second shootbolt slidably located in a second shootbolt housing, said second shootbolt configured to be mounted in a bottom edge of the door wherein the second shootbolt housing is installed into a second aperture positioned on the other of the top edge and bottom edge of the door;

a second driverail having proximal and distal opposite ends, said second driverail configured to be installed into the narrow groove defined in the lateral edge of the door, said second driverail being installed in said narrow groove in a vertically slidable manner;

the second aperture is adjacent to and in communication with the narrow groove, wherein the width or diameter of the second aperture is larger than the width or diameter of the narrow groove;

the distal end of said second driverail being engageable with said second shootbolt to drive said second shootbolt between a retracted position in the second shootbolt housing and an extended position from the other of the top edge and bottom edge of the door;

wherein said second driverail includes a second engagement element adjacent said proximal end thereof, the second engagement element being a notch defined in said second driverail adjacent said proximal end thereof, the notch opening in a direction extending out of the narrow groove when the second driverail is installed in the narrow groove; and a mortise unit adapted for installation into the lateral edge of the door through the narrow groove, said mortise unit having first and second driving elements associated therewith that are moveable between unlocked and locked positions, said first driving element including a member configured to extend in a direction from the first lateral edge to the second lateral edge when the mortise unit is installed in the door, the notch in the first drive rail opening in a direction extending out of the narrow groove such that the member extends into the notch in the first drive rail as the mortise unit is installed in the door after the first drive rail has been installed in the narrow groove, the member extending in the direction from the first lateral edge to the second lateral edge configured to move vertically to interact with said first engagement element in said first driverail when said mortise unit is installed into the lateral edge of the door through the narrow groove after said first driverail has been installed into said narrow groove to drive said first driverail, said second driving element including a member configured to extend in a direction from the first lateral edge to the second lateral edge when the mortise unit is installed in the door through the narrow groove, the notch in the second drive rail opening in a direction extending out of the narrow groove such that the member extends into the notch in the second drive rail as the mortise unit is installed in the door through the narrow groove after the second drive rail has been installed in the narrow groove, the member configured to interact with said second engagement element in said second driverail when said mortise unit is installed into the lateral edge of the door through the narrow groove after said second driverail has been installed into said narrow groove to drive said second driverail;

wherein said first and second shootbolts are driven from said retracted position to said extended position when said driving element of said mortise unit is moved from said unlocked position to said locked position.

9. The multi-point lock of claim 8, wherein the mortise is one of an active mortise and an inactive mortise.

10. The multi-point lock of claim 8, further comprising a cap configured to cover at least the width of the narrow groove.

11. The multi-point lock of claim 10, wherein the cap is configured to engage the narrow groove.

12. The multi-point lock of claim 8, wherein the narrow groove is configured as a groove having a width or diameter within a range of 4% to 20% of the width of the lateral edge of the door.

13. The multi-point lock of claim 12, wherein the narrow groove has a width or diameter within a range of 7% to 15% of the width of the lateral edge of the door.

14. A method of installing a multi-point lock into a door, comprising:

mounting at least one shootbolt assembly comprising a shootbolt slidably located in a shootbolt housing;

installing the shootbolt housing into an aperture positioned on one of the top edge and bottom edge of the;

installing at least one driverail in a narrow groove defined in a lateral edge of the door in a vertically slidable manner, said driverail having proximal and distal opposite ends, said distal end of said driverail being engaged with said shootbolt to drive said shootbolt between a retracted position in the shootbolt housing and an extended position from one of the top edge and bottom edge of the door, said driverail having a notch defined in said proximal end thereof, the notch opening in a direction extending out of the narrow groove when the driverail is installed in the narrow groove;

installing a mortise unit into the lateral edge of the door through the narrow groove after said driverail has been installed into said narrow groove, said mortise unit having a driving element associated therewith that is moveable between unlocked and locked positions, said driving element including a mating member extending into the notch defined in said driverail, wherein said step of installing a mortise unit into the lateral edge through the narrow groove engages the mating member into the notch; and driving said shootbolt from said retracted position to said extended position by moving said driving element of said mortise unit from said unlocked position to said locked position.

15. The method of installing a multi-point lock into a door of claim 14, wherein the mortise is one of an active mortise and an inactive mortise.

16. The method of installing a multi-point lock into a door of claim 14, further comprising providing a cap configured to cover at least the width of the groove.

17. The method of installing a multi-point lock into a door of claim 16, including installing the cap to engage the groove.

18. The method of installing a multi-point lock into a door of claim 14, further comprising:

mounting at least one additional shootbolt assembly comprising an additional shootbolt slidably located in an additional shootbolt housing, wherein the additional shootbolt housing is installed into an additional aperture positioned on one of the top edge and bottom edge of the door;

providing at least one additional driverail having proximal and distal opposite ends in said narrow groove in a vertically slidable manner, said distal end of said additional driverail coupling with said additional shootbolt to drive said additional shootbolt between a retracted position in the shootbolt housing and an extended position from one of the top edge and bottom edge of the door, said driverail having an engagement element located in said proximal end thereof, wherein the mortise unit includes an additional driving element associated therewith that is moveable between unlocked and locked positions, said additional driving element engaging said additional engagement element in said additional driverail; and driving both shootbolts from said retracted position to said extended position by moving both driving elements of said mortise unit from said unlocked position to said locked position.

19. The method of installing a multi-point lock into a door of claim 14, wherein the narrow groove is configured as a groove having a width or diameter within a range of 4% to 20% of the width of the lateral edge of the door.

20. The method of installing a multi-point lock of claim 19, wherein the narrow groove has a width or diameter within a range of 7% to 15% of the width of the lateral edge of the door.

21. A multi-point lock comprising:

at least one shootbolt assembly comprising a shootbolt located in a shootbolt housing, said shootbolt for mounting in one of a top and bottom edge of a door, wherein the shootbolt housing is installed into an aperture positioned on one of the top edge and bottom edge of the door;

at least one driverail having proximal and distal opposite ends, said driverail configured for installation into a narrow groove defined in a lateral edge of the door in a vertically slidable manner;

the aperture is adjacent to and in communication with the narrow groove, wherein the width or diameter of the aperture is larger than the width or diameter of the narrow groove;

the distal end of said driverail being engageable with said shootbolt to drive said shootbolt between a retracted position in the shootbolt housing and an extended position from one of the top edge and bottom edge of the door;

wherein said driverail includes a notch defined in a first side thereof adjacent said proximal end thereof, the driverail being configured to be located in the narrow groove with the first side of the driverail including the notch located proximate the lateral edge of the door, the notch opening in a direction extending out of the narrow groove when the driverail is installed in the narrow groove;

at least one bolt configured for mounting in the narrow groove and pivotally coupled to the driverail, with the bolt configured to extend from and retract into the narrow groove in unison with movement of the shootbolt; and a mortise unit adapted for installation into the lateral edge of the door through the narrow groove, said mortise unit having a driving element associated therewith that is moveable between unlocked and locked positions, said driving element extending into in the notch in the driverail when said mortise unit is installed into the lateral edge of the door through the narrow groove after said driverail have been installed into said narrow groove to place the driving element in operative engagement with the driverail;

wherein said shootbolt and said bolt are driven from said retracted position to said extended position when said driving element of said mortise unit is moved from said unlocked position to said locked position.

22. The multi-point lock of claim 21, wherein the mortise is one of an active mortise and an inactive mortise.

23. The multi-point lock of claim 21, further comprising a cap configured to cover at least the width of the groove, with the cap defining an aperture configured to expose the said bolt.

24. The multi-point lock of claim 23, wherein the cap is configured to engage the narrow groove.

25. The multi-point lock of claim 21, wherein the narrow groove is configured as a groove having a width or diameter within a range of 4% to 20% of the width of the lateral edge of the door.

26. The multi-point lock of claim 25, wherein the narrow groove has a width or diameter within a range of 7% to 15% of the width of the lateral edge of the door.

27. The multi-point lock of claim 21, wherein the shootbolt and the driverail are a single member.

28. A door and lock system comprising:

a door including a top edge, a bottom edge, a first lateral edge in which a narrow groove is defined, a second lateral edge opposite the first lateral edge, the narrow groove opening outward in a direction extending away from the second lateral edge;

a multi-point lock including:

at least one shootbolt assembly comprising a shootbolt slidably located in a shootbolt housing mounted in one of a top and bottom edge of the door, wherein the shootbolt housing is installed into an aperture positioned in one of the top edge and the bottom edge of the door, the aperture is adjacent to and in communication with the narrow groove, the width or diameter of the aperture is larger than the width or diameter of the narrow groove;

at least one driverail having proximal and distal opposite ends, said driverail installed in the narrow groove defined in the first lateral edge of the door, the driverail being installed in said narrow groove in a vertically slidable manner, the narrow groove guiding and retaining the driverail in the door throughout the driverail motion, said distal end of said driverail being engageable with said shootbolt to drive said shootbolt between a retracted position in the shootbolt housing and an extended position from one of the top edge and the bottom edge of the door;

a notch defined in said driverail adjacent said proximal end thereof, the notch opening in a direction extending out of the narrow groove when the driverail is installed in the narrow groove; and a mortise unit installed into the lateral edge of the door through the narrow groove, said mortise unit having a driving element associated therewith that is moveable between unlocked and locked positions, said driving element extending into the notch defined in said driverail when said mortise unit is installed into the lateral edge of the door through the narrow groove after said driverail has been installed into said narrow groove to place the driving element in operative engagement with the driverail;

wherein said shootbolt is driven from said retracted position to said extended position when said driving element of said mortise unit is moved from said unlocked position to said locked position.

* * * * *